US008714168B2

(12) United States Patent
Schwab

(10) Patent No.: US 8,714,168 B2
(45) Date of Patent: May 6, 2014

(54) HIGH-PRESSURE CLEANING APPLIANCE

(75) Inventor: Werner Schwab, Rudersberg (DE)

(73) Assignee: Alfred Kaercher GmbH & Co. KG, Winnenden (DE)

( * ) Notice: Subject to any disclaimer, the term of this patent is extended or adjusted under 35 U.S.C. 154(b) by 14 days.

(21) Appl. No.: 13/435,032

(22) Filed: Mar. 30, 2012

(65) Prior Publication Data

US 2013/0014788 A1 Jan. 17, 2013

Related U.S. Application Data

(63) Continuation of application No. PCT/EP2009/063435, filed on Oct. 14, 2009.

(51) Int. Cl.
*B08B 3/00* (2006.01)

(52) U.S. Cl.
USPC ..... 134/105

(58) Field of Classification Search
USPC ..... 134/105, 107
See application file for complete search history.

(56) References Cited

U.S. PATENT DOCUMENTS

| | | | | |
|---|---|---|---|---|
| 5,245,714 | A * | 9/1993 | Haraga et al. | 4/541.2 |
| 2003/0080222 | A1 | 5/2003 | Faller et al. | |
| 2008/0128032 | A1 | 6/2008 | Lapetina et al. | |

FOREIGN PATENT DOCUMENTS

| | | |
|---|---|---|
| DE | 36 17 556 | 12/1987 |
| DE | 93 03 648 | 8/1993 |
| DE | 44 45 521 | 12/1995 |
| DE | 196 07 882 | 2/1997 |
| EP | 0 890 394 | 1/1999 |
| WO | WO 2008/030799 | 3/2008 |

OTHER PUBLICATIONS

Machine Translation of Obenland et al. EP 890394, Jan. 1999.*

* cited by examiner

*Primary Examiner* — David Cormier
(74) *Attorney, Agent, or Firm* — Lipsitz & McAllister, LLC

(57) ABSTRACT

The invention relates to a high-pressure cleaning appliance, comprising a heatable heat exchanger for heating a liquid that can be discharged by the high-pressure cleaning appliance, a motor having a drive shaft that defines a drive axis, a pump unit for increasing the liquid pressure, a blower wheel for generating a combustion air flow, and a fuel pump for delivering a fuel to the heat exchanger, wherein the pump unit, the blower wheel, and the fuel pump are disposed along the drive axis and can be driven by means of the drive shaft and form an assembly together with the motor. In order to improve such a high-pressure cleaning appliance in such a manner that it has a more compact construction and a smaller space requirement, the assembly of the high-pressure cleaning appliance according to the invention, with regard to a height direction thereof, is disposed below the heat exchanger.

15 Claims, 5 Drawing Sheets

HIGH-PRESSURE CLEANING APPLIANCE

This application is a continuation of international application number PCT/EP2009/063435 filed on Oct. 14, 2009.

The present disclosure relates to the subject matter disclosed in international application number PCT/EP2009/063435 of Oct. 14, 2009, which is incorporated herein by reference in its entirety and for all purposes.

BACKGROUND OF THE INVENTION

1. Field of the Invention

The invention relates to a high-pressure cleaning appliance, comprising a heatable heat exchanger for heating a liquid that can be discharged by the high-pressure cleaning appliance, a motor having a drive shaft that defines a drive axis, a pump unit for increasing the liquid pressure, a blower wheel for generating a combustion air flow, and a fuel pump for delivering a fuel to the heat exchanger, wherein the pump unit, the blower wheel, and the fuel pump are disposed along the drive axis and can be driven by means of the drive shaft and form an assembly together with the motor.

2. Description of Related Art

Such a high-pressure cleaning appliance is described in DE 36 17 556 A1, in which the assembly is installed standing in upright position with a vertically aligned drive axis next to a heat exchanger which likewise stands in an upright position and has a vertically aligned axis. Due to this design, the high-pressure cleaning appliance has a significant space requirement; in particular, it requires considerable floor space.

It is an object of the present invention to improve a generic high-pressure cleaning appliance in such a manner that it has a more compact construction and a smaller space requirement.

BRIEF SUMMARY OF THE INVENTION

This object is achieved according to the invention for a high-pressure cleaning appliance of the aforementioned kind by the assembly, with regard to a height direction of the high-pressure cleaning appliance, being disposed below the heat exchanger.

In the case of the high-pressure cleaning appliance according to the invention, a compact construction can be achieved, on the one hand, by the motor being used for driving the pump unit, the blower wheel and the fuel pump. For this reason, it is not required to provide in each case separate drives for the pump unit, the blower wheel and the fuel pump. On the other hand, the assembly in the high-pressure cleaning appliance according to the invention is disposed below the heat exchanger. This allows, for example, load-bearing components of the high-pressure cleaning appliance, such as a chassis, to be formed smaller than those of high-pressure cleaning appliances known from the prior art. Also, parts of a possible casing can be downsized resulting overall in a more compact construction and a lower space requirement for the high-pressure cleaning appliance. Moreover, the high-pressure cleaning appliance according to the invention requires less floor space.

It is beneficial if the drive axis is aligned horizontally. Thereby, the space required for the high-pressure cleaning appliance can be reduced. Furthermore, with this embodiment, it is possible to shift the center of gravity of the high-pressure cleaning appliance downward compared to an embodiment in which the drive axis is for example aligned vertically. In this manner, the high-pressure cleaning appliance is more stable, which can reduce the demands on load-bearing parts of the high-pressure cleaning appliance. This, in turn, is beneficial for a compact construction of the high-pressure cleaning appliance.

Preferably, the high-pressure cleaning appliance has at least one pair of wheels rotatable about a common axis of rotation, parallel to which the drive axis is aligned. By means of the wheels, the high-pressure cleaning appliance can be moved on a set-down surface. In particular, it can be provided that the high-pressure cleaning appliance can be tilted about the contact points of the wheels on the set-down surface and can be transported in a manner similar to a sack truck. The alignment of the drive axis parallel to the axis of rotation has proven in practice to be advantageous for the stability of the high-pressure cleaning appliance. It was found that in this manner, torques coming from the motor can be better transferred to load-bearing components of the high-pressure cleaning appliance on which the wheels are held than is the case, for example, when the drive axis has a perpendicular orientation relative to the axis of rotation.

Advantageously, the high-pressure cleaning appliance has a heat exchanger which stands in an upright position and has an axis that is aligned in the height direction. In this manner, a high-pressure cleaning appliance can be constructed that takes up only a small amount of floor space. Advantageously, the axis of the heat exchanger is aligned vertically during operation so as to improve the stability of the high-pressure cleaning appliance.

If the high-pressure cleaning appliance, as described above, is tiltable and movable on a set-down surface like a sack truck, it has been proven in practice to be beneficial if the heat exchanger has an axis which is disposed with regard to the longitudinal direction of the high-pressure cleaning appliance between the axis of rotation of the wheels and the drive axis.

Preferably, the high-pressure cleaning appliance comprises a chassis on which the assembly is held, and a supporting device which at least partially covers the latter and on which the heat exchanger is held. This facilitates the assembling of the high-pressure cleaning appliance. The assembly can be connected to the chassis, and the heat exchanger can be connected to the supporting device. Subsequently, the supporting device can be connected to the chassis, for example in a force-locking and/or positively-locking manner.

It is beneficial if the supporting device is detachably connectable to the chassis because this, besides a simplified assembling of the high-pressure cleaning appliance, facilitates also the simplified maintenance of the same. Here, it can be in particular provided that the supporting device can be detached from the chassis with very few hand movements and entirely or largely without the use of tools.

It is advantageous if, after detaching the supporting device from the chassis, the assembly or, if applicable, a cover covering the latter, is freely accessible for a user in order to make the maintenance of the high-pressure cleaning appliance easier.

Preferably, the supporting device has a plate-shaped supporting member that has a supporting surface for the heat exchanger. The heat exchanger can be mounted in a stable manner on the supporting member, and the supporting member can be fixed, for example, on support elements disposed on the chassis. Advantageously, below the supporting member, there is an accommodating chamber in which the assembly is at least partially disposed. After detaching the supporting member from the chassis, the assembly or, where applicable, a cover covering the same is freely accessible to a user.

Advantageously, the motor or a unit formed of motor and pump unit is disposed at a longitudinal center axis of the high-pressure cleaning appliance. Thereby, the stability of the high-pressure cleaning appliance can be increased because the motor or the unit consisting of motor and pump unit accounts for the largest portion of the mass of the assembly.

Heretofore, the structure of the assembly has not been addressed yet. In terms of said structure, it is beneficial if, in the axial direction with regard to the drive axis, the pump unit forms a first end of the assembly. This is of advantage, for example, during maintenance of the high-pressure cleaning appliance, for instance if maintenance work is to be carried out on a supply conduit for liquid to be pressurized and/or on a discharge conduit for pressurized liquid, which conduits are held on the pump unit. The pump unit can be easily accessed by the user in this embodiment.

Preferably, the pump unit protrudes at least partially beyond an outer boundary of the heat exchanger. This too makes it easier for a user to reach the pump unit, for example to carry out maintenance work.

It is of advantage if the high pressure cleaning appliance comprises, as a component part of the assembly, a fan which is disposed on the drive axis and can be driven by the drive shaft so as to generate a cooling air flow that cools the motor. By means of the fan, a cooling air flow for the motor can be provided so that overheating of the same can be avoided. Because the fan is driven by the motor, it is not necessary to provide a separate drive for the fan. This facilitates a compact construction of the high-pressure cleaning appliance.

In order to achieve effective cooling of the motor, it is of advantage if the fan is held on the drive shaft and is located, with regard to the drive axis, axially upstream of the motor. Said fan can be configured in particular as an axial fan.

Preferably, the pump unit is disposed on the side of the motor that faces away from the fan, because this gives the possibility to cool, by means of the cooling air flow, not only the motor, but also the pump unit.

It is beneficial if the blower wheel is disposed on the side of the fan that faces away from the motor. By means of the blower wheel, a combustion air flow for the heat exchanger is generated. Due to the fact that the blower wheel is disposed, with regard to the drive axis, axially upstream of the fan, it can be largely avoided that the combustion air comprises only air that is heated through the waste heat of the motor. In practice, this has proven to be advantageous for the operation of the heat exchanger.

It is beneficial if the blower wheel protrudes at least partially beyond an outer boundary of the heat exchanger and if the high-pressure cleaning appliance has a flow channel for combustion air which extends from the blower wheel and points toward the heat exchanger. In this manner, the flow channel can be given a simple construction. For example, starting from the blower wheel, said flow channel can extend in a straight line in a height direction.

Preferably, the heat exchanger has a housing shell which, on its side facing toward the blower wheel, has an inlet opening for combustion air, at which opening the flow channel is connected to the heat exchanger approximately tangentially to the housing shell. Thereby, the combustion air flow can enter into the housing of the heat exchanger with an approximately tangential flow direction, which was found in practice to be advantageous for operating the heat exchanger.

It is beneficial if, in the axial direction with regard to the drive axis, the fuel pump forms a second end of the assembly because in this way, the fuel pump is easier for a user to reach, for example during maintenance of the high-pressure cleaning appliance. During maintenance work it can be provided, for instance, that fuel conduits are to be connected to the fuel pump or disconnected therefrom, which can be performed with this embodiment in a simpler manner.

For the same reason it is preferred if the fuel pump protrudes at least partially beyond an outer boundary of the heat exchanger.

Advantageously, the high-pressure cleaning appliance comprises a fuel tank above the fuel pump. Thereby, the fuel conduit connecting the tank to the fuel pump can be formed as short as possible. For example, the tank can be disposed next to the heat exchanger.

Preferably, the high-pressure cleaning appliance has a half-shell housing comprising a first half-shell and a second half-shell which define between them an accommodating chamber in which the assembly is at least partially accommodated. This facilitates, on the one hand, a compact construction of the high-pressure cleaning appliance in which the assembly is at least partially accommodated in the accommodating chamber. In the half-shell housing, for example, said assembly can be held as a whole. In this case, no separate fixation of the individual components, i.e., of the motor, the pump unit, the blower wheel, the fuel pump and, if applicable, the fan, is required. On the other hand, the assembling of the high-pressure cleaning appliance is simplified. For example, it can be provided that the assembly is to be inserted into the first half-shell and is at least partially covered by the second half-shell which is fixed to the first half-shell. Furthermore, the use of the half-shell housing enables protecting of the assembly which is at least partially accommodated in the latter.

It can be provided that the fuel pump and/or the pump unit are at least partially disposed outside of the half-shell housing. Thereby, on the one hand, by using the half-shell housing, the aforementioned advantages can be achieved and, on the other hand, as likewise already mentioned, maintenance work on the pump unit and/or on the fuel pump can be carried out in a user-friendly manner.

A simple constructional arrangement of the high-pressure cleaning appliance is obtained if it comprises a chassis which forms the first half-shell and/or the second half-shell. Thus, for fitting the assembly on the high-pressure cleaning appliance, it can be provided, for instance, that the assembly is to be inserted into the chassis forming the first half-shell in order to be subsequently covered by a cover forming the second half-shell.

BRIEF DESCRIPTION OF THE DRAWINGS

The following description of a preferred embodiment of the invention serves, in connection with the drawing, for a more detailed explanation of the invention. In the figures.

DETAILED DESCRIPTION OF THE DRAWINGS

Figure 1:
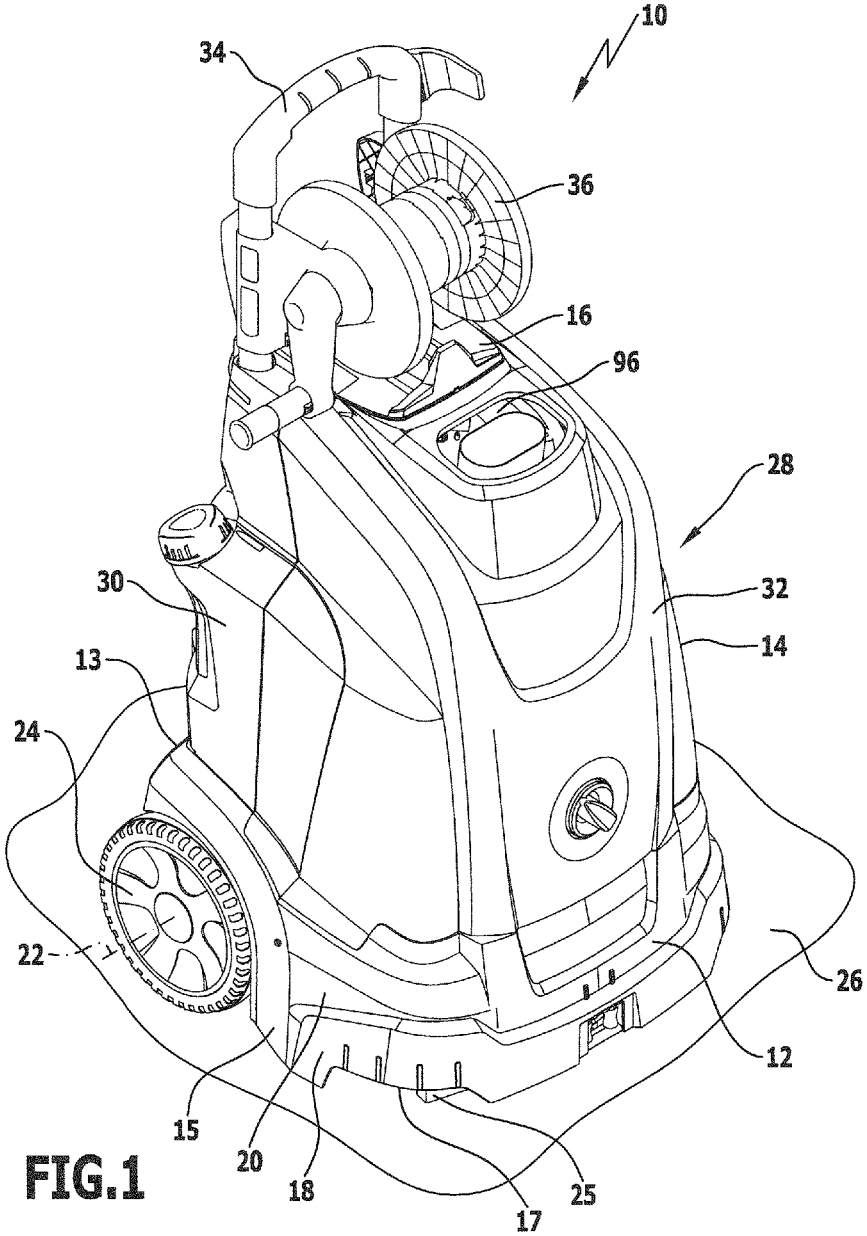
FIG. 1 shows a perspective view of a high-pressure cleaning appliance according to the invention having a bottom part and a housing that is disposed above the same and comprises a hood.

A preferred embodiment of a high pressure cleaning appliance according to the invention is shown in FIG. 1 in a perspective view and is designated there as a whole by the reference number 10. It has a front side 12, a rear side 13, a left side 14, a right side 15, an upper side 16 and a lower side 17.

Figure 4:
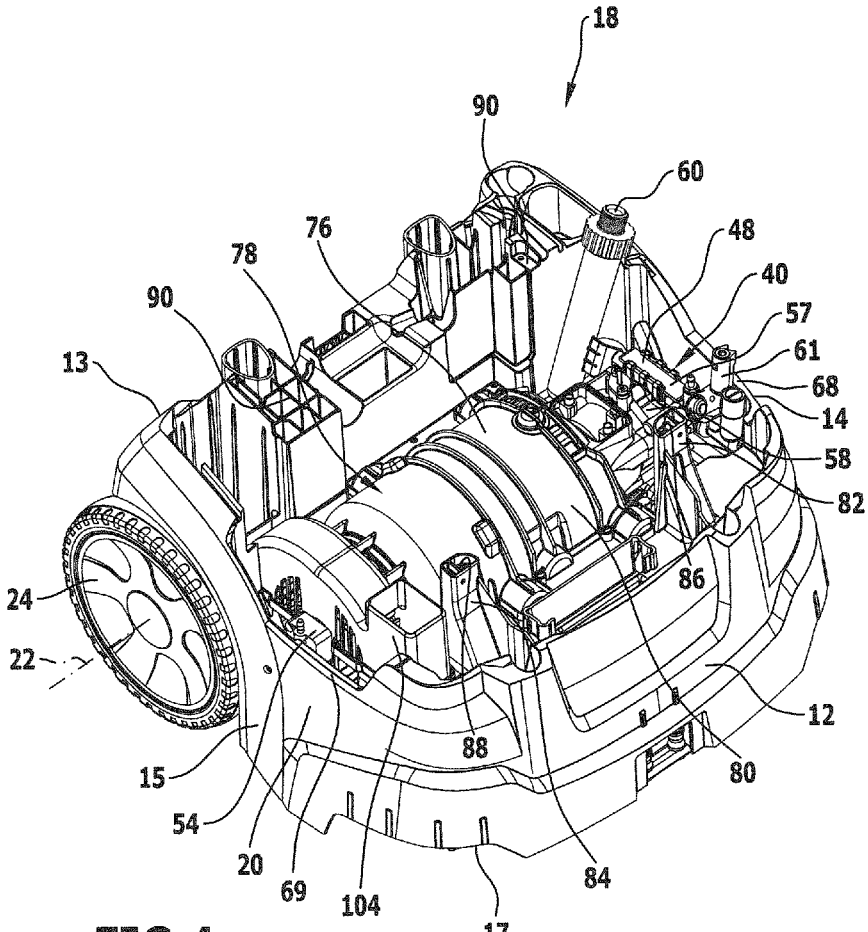
FIG. 4 shows a perspective view of the bottom part of the high-pressure cleaning appliance of FIG. 1.
Figure 5:
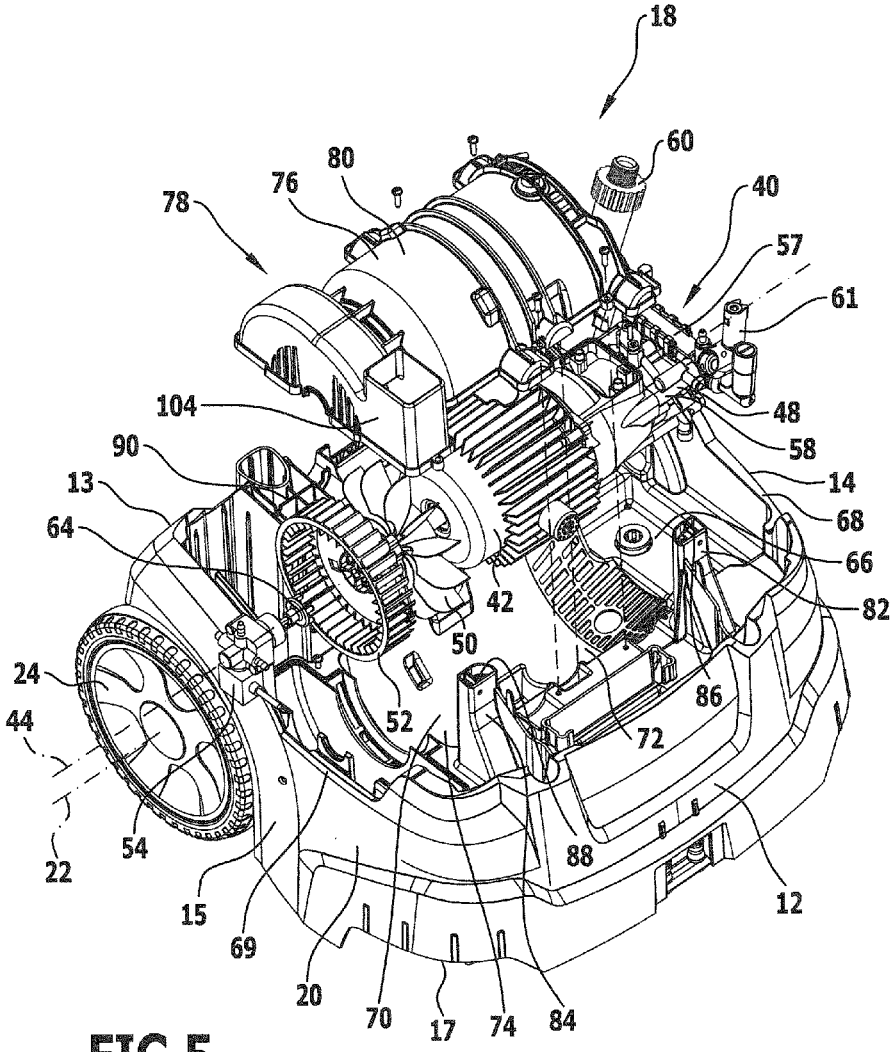
FIG. 5 shows the bottom part of FIG. 4, partially in an exploded view.

The high-pressure cleaning appliance 10 comprises a bottom part 18 which is illustrated in the FIGS. 4 and 5 and has a chassis 20 on which, near the rear side 13 on the left side 14 and on the right side 15, two wheels are held which are rotatable about a common axis 22 of rotation. In the drawing, only the right wheel 24 is shown. Near the front side 12, the high-pressure cleaning appliance 10 has on the lower side 17 a plurality of support elements of which only a support leg 25 is visible in the drawing. With these support elements and the wheel 24 as well as the non-illustrated wheel, the high-pressure cleaning appliance 10 can stand on a set-down surface 26.

Figure 2:
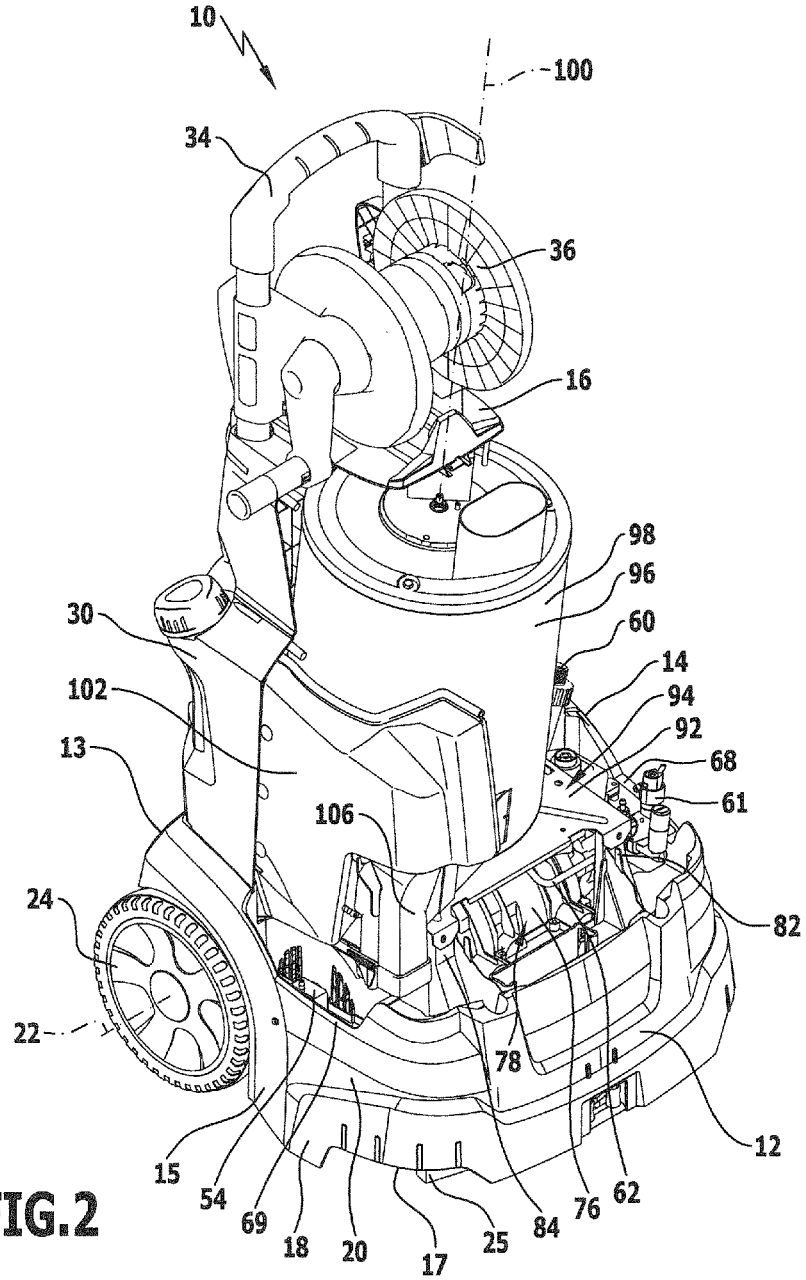
FIG. 2 shows the high-pressure cleaning appliance of FIG. 1 after removing the hood.

Above the bottom part 18, the high-pressure cleaning appliance 10 has a housing 28. The housing 28 is formed by a rear housing wall 30 on the rear side 13 and on the portions of the left side 14 and right side 15 that face toward the rear side 13, and further, by a hood 32 on the front side 12 and on the portions of the left side 14 and right side 15 that face toward the front side 12. The hood 32 can be detached in a simple and user-friendly manner from the housing wall 30 and from the bottom part 18 so that the high-pressure cleaning appliance 10 is substantially presented to a user as illustrated in FIG. 2. The structure of the high-pressure cleaning appliance 10 underneath the hood 32 will be addressed hereinafter.

On the upper side 16, the high-pressure cleaning appliance 10 has a handle in the form of a hand grip 34. A user can grasp the latter in order to tilt the high-pressure cleaning appliance 10 about the contact points of the wheel 24 and the non-illustrated wheel on the set-down surface 26 and thereby to move the high-pressure cleaning appliance 10 on the set-down surface 26 in a manner similar to a sack truck.

A hose reel 36 held near the hand grip 34 above the housing 28 serves for accommodating a high-pressure hose which is not shown in the drawing and through which cleaning liquid pressurized by the high-pressure cleaning appliance can be discharged.

Figure 3:
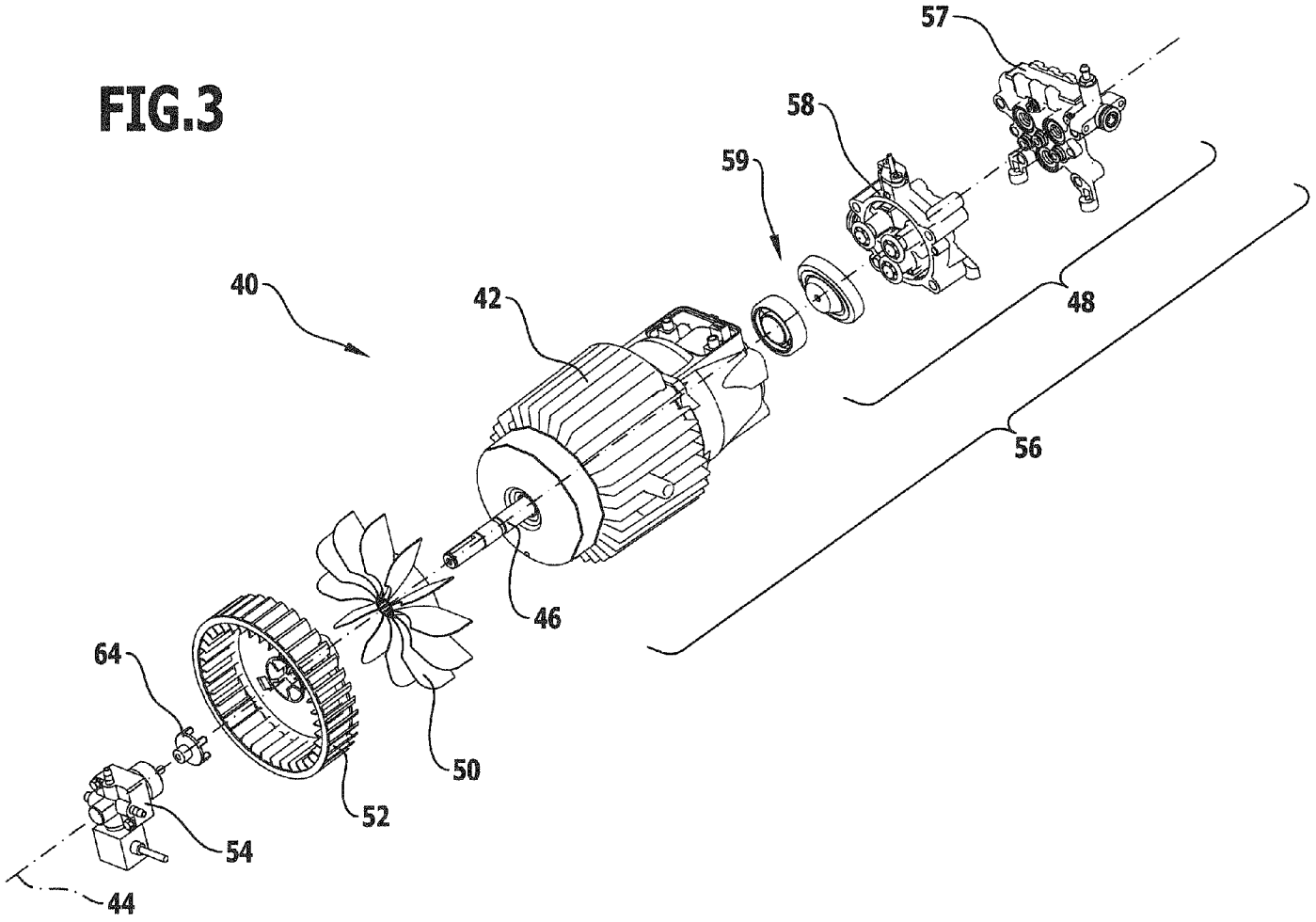
FIG. 3 shows an assembly from the high-pressure cleaning appliance of FIG. 1, comprising a motor, a pump unit, a fan, a blower wheel and a fuel pump, in an exploded view.

In order to pressurize by means of the high-pressure cleaning appliance 10 a liquid, for example water, fed to said high-pressure cleaning appliance 10, the latter has an assembly 40 shown in an exploded view in FIG. 3. The assembly 40 comprises a motor 42 having a drive shaft 46 that defines a drive axis 44, a pump unit 48, a fan 50, a blower wheel 52 and a fuel pump 54. The motor 52 is formed as an electric motor and flanged thereto is the pump unit 48 which is formed as an axial piston pump. In this manner, the motor 42 and the pump unit 48 form a common unit 56.

In the axial direction with regard to the drive axis 44, the pump unit 48 forms a first end of the assembly 40. For the formation as an axial piston pump, the pump unit has a pump head 57, a pump block 58 and a swash plate arrangement 59 so that the pump unit 48 can be driven in a manner known per se by the drive shaft 46. Furthermore, the drawing shows a supply conduit 60 for liquid to be pressurized and a connecting element 61 on the pump head 57. A discharge conduit 62 (FIG. 2) for pressurized liquid is connected to the connecting element 61.

The fan 50 is held on the drive shaft 46 on the side of the motor 42 that faces away from the pump unit 48 and is located directly upstream of the motor 42. In this manner, it can also be driven by the drive shaft 46. It is formed as an axial fan.

Disposed upstream of the fan 50 in the direction toward the drive axis 44 is the blower wheel 52 which is formed as a radial fan. The latter is also held on the drive shaft 46 and can be driven by the same.

The fuel pump 54 is coupled in a rotationally fixed manner by means of a coupling member 64 to the side of the blower wheel 52 that faces away from the fan 50. Thereby, the fuel pump 54 can also be driven by the drive shaft 46. The fuel pump 54 forms, in the axial direction with regard to the drive axis 44, a second end of the assembly 40.

The above-described structure of the assembly 40, by which the pump unit 48, the fan 50, the blower wheel 52 and the fuel pump 54 can be driven by the drive shaft 46, enables a compact structure of the high-pressure cleaning appliance 10 in which the motor 42 can be employed as the only drive. Therefore, no space for an additional drive is necessary.

As is in particular apparent from the FIGS. 4 and 5, the assembly 40 can be fitted in a simple and space-saving manner on the high-pressure cleaning appliance 10. At the bottom part 18 and in particular on the chassis 20, there is a receptacle 66 for the assembly 40. Said receptacle 66 extends from an edge 68 formed by the chassis 20 on the left side 14 to an edge 69 formed by the chassis 20 on the right side 15. A bottom wall 70 of the receptacle 66 runs horizontally near the edge 68. Adjoining this horizontal portion in the direction of the edge 69, the bottom wall 70 runs arch-shaped in the direction of the lower side 17, namely substantially in three portions with different radii of curvature of the bottom wall 70. A first relatively large portion is disposed approximately in the region of the middle of the high-pressure cleaning appliance 10, a second relatively narrow portion is disposed near the edge 69, and a third even narrower portion lies in the transverse direction of the high-pressure cleaning appliance 10 between the two aforementioned portions.

As a whole, the chassis 20 thereby forms in the region of the arch-shaped bottom wall 70 a trough 72 which is aligned transverse to the longitudinal direction of the high-pressure cleaning appliance 10. In the transverse direction of the high-pressure cleaning appliance 10, the trough extends from a point which is spaced from the edge 69 about a tenth of the distance by which the edge 68 is spaced from the edge 69 up to a point which is spaced from the edge 69 about three quarters of the distance by which the edge 68 is spaced from the edge 69.

The chassis 20 is, in terms of manufacturing, produced in a cost-effective manner and is made in a simple manner in one piece from a plastics material, forms in the region of the trough 72 a first lower half-shell 74 into which the assembly 40 can be at least partially inserted (FIG. 5, in which first the fuel pump 54 is to be coupled by means of the coupling member 64 to the blower wheel 52). When the assembly 40 is inserted into the half-shell 74, it extends down with its lower half facing toward the bottom wall 70 into a half-chamber above the latter so that the drive axis 44 is aligned horizontally and parallel to the drive axis 22. Due to the horizontal alignment of the drive axis 44, fitting the assembly 40 in front the wheel 24 and the non-illustrated wheel, with regard to the longitudinal direction of the high-pressure cleaning appliance 10 (FIG. 4), is made possible. In this manner, the chassis 20 can be formed sufficiently small for only a small area of floor space to be required. Moreover, the fitting of the assembly 40 with the horizontal drive axis 44 facilitates compact dimensions of the high-pressure cleaning appliance 10 in its height direction and, furthermore, a low center of gravity of the high-pressure cleaning appliance 10. Due to the low center of gravity, the latter is characterized by a high level of stability.

In a manner which is not described in detail, the assembly 40 can be fixed in the first half-shell 74, axially and radially with regard to the intended and "proper" alignment of the drive axis 44. For further fixation of the assembly 40 on the chassis 20, there serves a second half-shell 76 which, together with the first half-shell 74, forms a half-shell housing 78 of the high-pressure cleaning appliance 10. The half-shell 76 is made in one piece from a plastics material and is configured in the form of a semicircular cover 80 with approximately the shape of a trough that is turned upside down. It is detachably connectable to the half-shell 74.

The assembly 40 is partially accommodated in an accommodating chamber between the half-shells 74 and 76, the blower wheel 52, the fan 50 and approximately that half of the unit 56 formed of motor 42 and pump unit 48 that faces towards the fan 50 being accommodated in the accommodating chamber. The fuel pump 54 and the pump unit 48, which, in the axial direction with regard to the drive axis 44, form in each case ends of the assembly 40, are disposed outside the half-shell housing 78. By virtue of this construction, the half-shell housing 78 protects the assembly 40 at least partially against external influences and direct access by a user. However, for maintenance purposes, the fuel pump 54 and the pump unit 48 are accessible to the user in a user-friendly manner.

Viewed in the longitudinal direction of the high-pressure cleaning appliance 10, two support elements 82 and 84 extending in a height direction protrude from the chassis 20 between the trough 72 and the front side 12. The support element 82 is disposed in the axial direction, with regard to the drive axis 44, approximately in the region of the middle of the unit 56, and the support element 84 is disposed in the axial direction approximately in the region between the fan 50 and the blower wheel 52. The support elements 82 and 84 form horizontal supporting regions 86 and 88, respectively.

A further horizontal supporting region 90 shaped in a complex manner is formed by the chassis 20, viewed in the longitudinal direction of the high-pressure cleaning appliance 10, between the trough 72 and the rear side 13. Said supporting region 90 extends in the axial direction, with regard to the drive axis 44, approximately between the fan 50 and the pump unit 48 (FIG. 4).

A plate-shaped supporting member 92 of a supporting device 94 of the high-pressure cleaning appliance 10 rests on the supporting regions 86, 88 and 90. The plate-shaped supporting member 92 is detachably connectable to the chassis 20 in a manner that is not described in more detail, and it covers the half-shell housing 78 in the axial direction with regard to the drive axis 44 approximately from the fan 50 to the pump unit 48 (FIG. 2).

Mounted on the supporting member 92 is a heatable heat exchanger 96 that has a cylindrical housing shell 98 and a vertically oriented axis 100. The heat exchanger 96 is connected to the pump unit 48 via the already mentioned discharge conduit 62 in order to heat up pressurized liquid for improving the cleaning effect. Liquid heated by the heat exchanger 96 can be discharged via a discharge conduit which is not illustrated in the drawing and which, for example, can be connected to a high-pressure hose that can be stored on the hose reel 36.

The dimensions of the heat exchanger 96 are dimensioned such that it does not protrude beyond the plate-shaped supporting member 92 in the direction of the front side 12, the rear side 13, the left side 14 and the right side 15. This means that the pump unit 48 protrudes near the left side and the fuel pump 54 near the right side 15 beyond the outer boundary of the heat exchanger 96. The selection of such dimensions for the heat exchanger 96 thus facilitates ease of maintenance of the high-pressure cleaning appliance 10, in which the pump unit 48 and the fuel pump 54 are accessible in a user-friendly manner.

The upright standing alignment of the heat exchanger 96 with the vertically oriented axis 100 with its selected dimensions in the longitudinal and transverse direction of the high-pressure cleaning appliance 10 provides in addition that the latter, as already mentioned, requires only a small amount of floor space.

Underneath the housing 28, on the housing wall 30 between the heat exchanger 96 and the right side 15, a fuel container 102 is disposed which can be additionally supported on the chassis 20 in a manner that is not shown. Said container can accommodate the fuel which is required for operating the heat exchanger 96 and which can be fed to the fuel pump 54 through a first fuel conduit which is not illustrated in the drawing. A second fuel conduit, likewise not illustrated in the drawing, connects the fuel pump 54 to the heat exchanger 96.

Adjacent to the support element 84 side facing toward the right side 15, the upper half-shell 76 of the half-shell housing 78 forms a column-shaped connecting element 104 formed as a connection pipe. The connecting element 104 protrudes beyond the outer boundary of the heat exchanger 96 in the direction of the right side 15. Thereby, it is possible for a flow channel 106 held on the heat exchanger 96 to first extend in a compact construction and in a constructionally simple manner starting from the connecting element 104 in the height direction so that said flow channel passes the supporting member 92 in a space-saving manner. Above the supporting member 92, the flow channel 106 is bent in an approximately rectangular manner and runs horizontally, the end of said channel facing away from the connecting element 104 being approximately tangentially connected to the housing shell 98 of the heat exchanger 96. Combustion air provided by the blower wheel 52 can thus flow along an inner circumferential surface of the housing shell 98 into the heat exchanger 96, which has proven to be advantageous for the combustion process in the heat exchanger 96 during the operation of the high-pressure cleaning appliance 10.

In summary, by virtue of the arrangement of the assembly 40, which has only one drive with horizontally aligned drive axis 44, below the heat exchanger 96, which stands upright with a vertically aligned axis 100, the high-pressure cleaning appliance 10 can be provided with a very compact construction. Due to this construction, the high-pressure cleaning appliance 10 requires only little floor space. It has a low center of gravity and therefore is characterized by good stability.

The invention claimed is:

1. A high-pressure cleaning appliance, comprising:

a heatable heat exchanger for heating a liquid that is dischargeable by the high-pressure cleaning appliance, a motor having a drive shaft that defines a drive axis which is aligned horizontally, a pump unit for increasing a pressure of the liquid, a blower wheel for generating a combustion air flow, a fuel pump for delivering a fuel for the heat exchanger, the pump unit, the blower wheel and the fuel pump being disposed along the drive axis and being drivable by the drive shaft and forming an assembly together with the motor, and at least one pair of wheels rotatable about a common axis of rotation which is aligned parallel to the drive axis, wherein:

with regard to a height direction of the high-pressure cleaning appliance, the assembly is disposed below the heat exchanger, and the heat exchanger comprises a cylindrical heat exchanger that stands upright and comprises a vertical cylindrical axis that is aligned in the height direction.

2. The high-pressure cleaning appliance according to claim 1, further comprising:

a chassis on which the assembly is held, and a supporting device which covers said assembly at least partially and on which the heat exchanger is held.

3. The high-pressure cleaning appliance according to claim 2, wherein the supporting device is detachably connectable to the chassis.

4. The high-pressure cleaning appliance according to claim 2, wherein the supporting device has a supporting member that is configured in a plate-shaped manner and has a supporting surface for the heat exchanger.

5. The high-pressure cleaning appliance according to claim 1, wherein the motor or a unit formed of the motor and the pump unit is disposed at a longitudinal center axis of the high-pressure cleaning appliance.

6. The high-pressure cleaning appliance according to claim 1, wherein, in an axial direction with regard to the drive axis, the pump unit forms a first end of the assembly.

7. The high-pressure cleaning appliance according to claim 1, wherein the pump unit protrudes at least partially beyond an outer boundary of the heat exchanger.

8. The high-pressure cleaning appliance according to claim 1, further comprising, as a component part of the assembly, a fan which is disposed along the drive axis and is drivable by the drive shaft so as to generate a cooling air flow that cools the motor.

9. The high-pressure cleaning appliance according to claim 8, wherein the fan is disposed with regard to the drive axis axially upstream of the motor and is held on the drive shaft.

10. The high-pressure cleaning appliance according to claim 8, wherein the pump unit is disposed on a side of the motor that faces away from the fan.

11. The high-pressure cleaning appliance according to claim 8, wherein the blower wheel is disposed on a side of the fan that faces away from the motor.

12. The high-pressure cleaning appliance according to claim 1, wherein:

the blower wheel protrudes at least partially beyond an outer boundary of the heat exchanger, and a flow channel for combustion air is provided which extends from the blower wheel and points in a direction of the heat exchanger.

13. The high-pressure cleaning appliance according to claim 12, wherein the heat exchanger has a housing shell which, on a side facing toward the blower wheel, has an inlet opening for combustion air, at which opening the flow channel is connected to the heat exchanger approximately tangentially to the housing shell.

14. The high-pressure cleaning appliance according to claim 1, wherein, in an axial direction with regard to the drive axis, the fuel pump forms a second end of the assembly.

15. The high-pressure cleaning appliance according to claim 1, wherein the fuel pump protrudes at least partially beyond an outer boundary of the heat exchanger.

* * * * *